US006705829B1

(12) United States Patent
Brown et al.

(10) Patent No.: US 6,705,829 B1
(45) Date of Patent: Mar. 16, 2004

(54) COVER FOR LP FIRST STAGE DIAPHRAGM AND METHOD FOR IMPROVING INFLOW TO FIRST STAGE DIAPHRAGM

(75) Inventors: Daniel Mark Brown, Altamont, NY (US); Stephen R. Swan, Clifton Park, NY (US); Edward J. Sharrow, Scotia, NY (US); Carol A. Sterantino, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 22 days.

(21) Appl. No.: 10/241,447

(22) Filed: Sep. 12, 2002

(51) Int. Cl.[7] ..... F01D 9/04
(52) U.S. Cl. ..... 415/1; 415/208.1; 415/221
(58) Field of Search ..... 415/182.1, 208.1, 415/213.1, 220, 221, 1

(56) References Cited

U.S. PATENT DOCUMENTS

| | | | | |
|---|---|---|---|---|
| 3,945,760 A | * | 3/1976 | Miller | 415/189 |
| 3,973,870 A | * | 8/1976 | Desai | 415/169.4 |
| 4,288,677 A | * | 9/1981 | Sakata et al. | 219/121.14 |
| 4,616,975 A | | 10/1986 | Duncan | |
| 5,024,579 A | | 6/1991 | Groenendaal, Jr. | |
| 5,927,943 A | | 7/1999 | Maier | |

* cited by examiner

*Primary Examiner*—Ninh H. Nguyen
(74) *Attorney, Agent, or Firm*—Nixon & Vanderhye PC

(57) ABSTRACT

A cover is provided to conceal the forward-facing step defined by the protrusion of the first stage diaphragm into the LP inlet. The cover presents a smoothly contoured surface to the flowing fluid in both radial and circumferential directions and thus reduces energy loss of the working fluid, thereby to increase performance of the LP turbine.

21 Claims, 4 Drawing Sheets

COVER FOR LP FIRST STAGE DIAPHRAGM AND METHOD FOR IMPROVING INFLOW TO FIRST STAGE DIAPHRAGM

BACKGROUND OF THE INVENTION

The invention relates to a method and device for improving inflow to the first stage diaphragm of an axial flow turbine.

A typical axial flow turbine includes a rotor, a casing, and one or more turbine stages. Each stage is a cooperating combination of stationary and rotational components.

The rotational component is a wheel with a plurality of blades or buckets attached to its outer circumference. The wheel is coaxially mounted to the turbine shaft which is disposed to rotate about its axis. The assembly of the shaft and wheels is referred to as the turbine rotor.

The stationary component of the axial turbine stage is typically comprised of a diaphragm or a nozzle ring. A diaphragm of an axial flow turbine typically comprises inner and outer circumferential rings and a plurality of spaced apart vanes or nozzles. Each nozzle is fixedly secured at each end thereof to the inner and outer rings, respectively, for forming fluid flow passages therebetween. The outer ring is generally fixedly mounted to the inner shell of the turbine casing and the inner ring is spaced from and surrounds the turbine rotor. The nozzles control and direct flow of working fluid onto the energy extracting turbine blades or buckets. Thus, the nozzle passages are positioned radially about the first axis to line up with the buckets of the turbine rotor that are disposed axially behind the nozzle passages.

Each of the parts of the turbine discussed above has an upstream and a downstream side with respect to the flow of working fluid through the turbine. The turbine casing surrounds the turbine stage components. The casing also provides an inlet and exhaust for the working fluid. The inlet portion of the casing, called the inlet casing, is where the working fluid initially comes into the turbine. This inlet casing directs working fluid to the first stage stationary component.

In order to obtain maximum power from energy available from the working fluid, it is necessary for the flow of fluid be precisely controlled. The flow of working fluid must impinge the buckets at a predetermined optimum angle and the optimum fluid flow distribution from the radially inner portion of the root of the nozzle to the radially outer portion of tip of the nozzle must be maintained to accommodate a broad range of operation conditions.

On several externally fed LP steam turbines, the length of the assembled turbine stages is actually longer than the casing 26 that contains them. In such a case, the first stage nozzle diaphragm 18,24 often protrudes into the inlet casing, presenting a forward facing step 28 to the working fluid flow path from the inlet casing 16 into the first stage diaphragm 18,24, as illustrated in FIG. 1. As the inflowing steam encounters the step, it separates from a smoothly flowing pattern. This separation increases the energy loss of the working fluid (steam). If the energy loss associated with this separation can be reduced, more energy may be extracted by the turbine and converted to electricity.

Known methods for reducing energy loss in the LP inlet include metering the flow upstream of the inlet, contouring of inlet walls, and reducing flow velocity. While it may reduce losses in the inlet proper, metering of the flow anywhere in the flow path generates energy loss. For other reasons, it may be necessary to meter the flow upstream of the inlet step and thereby mitigate losses at the step. In such a case, there will be no additional loss. However, metering the flow is not an effective method if used specifically to target energy loss associated with the forward facing step presented by the protruding first stage nozzle diaphragm.

As noted, it is also possible to contour the inner surface of the inlet to redistribute the velocity profile at the first stage nozzle. However, there is no method of re-acquiring the lost energy associated with the diaphragm step protruding into the LP inlet. Also, this contouring method is very sensitive to surface contour and is often impractical.

Also noted above, an effective method of reducing steam flow velocity is to increase the volume of the LP inlet since losses are proportional to the square of velocity. The general disadvantage of this method, however, is that the cost of the larger inlet increases with added material. Furthermore, this method may influence the velocity profile at the first stage nozzle.

Therefore, a need remains for a device that can conceal the forward facing step from the working fluid flow without negatively disturbing the distribution of flow to the first stage nozzle.

BRIEF DESCRIPTION OF THE INVENTION

The invention is embodied in a cover that conceals the forward-facing step defined by the protrusion of the first stage diaphragm into the LP inlet. The cover presents a smoothly contoured surface to the flowing fluid in both radial and circumferential directions and thus reduces energy loss of the working fluid, thereby to increase performance of the LP turbine. The cover of the invention thus provides a solution to the energy loss problem while having no negative impact on the flow distribution to the first stage.

The invention is thus embodied in a cover for e.g., the LP first stage diaphragm, comprising: a generally flat plate main body having an outer peripheral edge and an inner peripheral edge, said outer peripheral edge being circular and said inner peripheral edge defining a generally discontinuous circle having a plurality of cutouts for receiving protruding structure of the inlet casing, said cover being pre-formed to define a generally curved contour from a plane of said outer peripheral edge to a plane of said inner peripheral edge, said plane of said outer peripheral edge and said plane of said inner peripheral edge being parallel and spaced apart according to said contour.

The invention may thus be embodied in an axial flow turbine including a rotor and turbine blades coupled to said rotor for converting at least a portion of energy available from a working fluid into mechanical energy, comprising: a diaphragm for circumferential disposition around the rotor for directing at least a portion of said working fluid onto said buckets, said diaphragm including a plurality of spaced apart nozzles forming a respective plurality of channels therebetween, an inlet casing for conducting working fluid to an upstream end of said diaphragm, said diaphragm protruding into said inlet casing to define a step, and a cover extending between a wall of said inlet casing and an upstream end of said diaphragm, said cover defining a gradual transition between the inlet casing wall and the upstream end of the diaphragm.

The invention may also be embodied in a turbine comprising: a shaft which extends along and rotates about a central axis; a rotor wheel mounted to the rotor; a plurality of buckets mounted to and around said rotor wheel; a diaphragm upstream of said rotor wheel, said diaphragm including a plurality of circumferentially arrayed nozzle vanes housed in a stationary flow path component and configured to direct fluid against an upstream side of the buckets to effect rotation of the rotor wheel; an inlet casing for conducting motive fluid to said diaphragm, said diaphragm projecting axially into an inlet chamber defined by said inlet casing so that said diaphragm defines a step from a wall of said inlet casing to an upstream end of said diaphragm, and a cover extending between said wall of said inlet casing and said upstream end of said diaphragm, said cover defining a gradual transition between the inlet casing wall and the upstream end of the diaphragm.

The invention is further embodied in a method for improving inflow from an inlet casing of a turbine into a first stage diaphragm thereof when said first stage diaphragm protrudes into said inlet casing, the method comprising: providing a cover that has a generally flat plate main body having inner and outer peripheral edges and a generally circular shape; mounting the cover to a wall of the inlet casing adjacent said outer peripheral edge; and disposing the inner peripheral edge of the cover at an upstream end of the first stage diaphragm.

BRIEF DESCRIPTION OF THE DRAWINGS

These and other objects and advantages of this invention, will be more completely understood and appreciated by careful study of the following more detailed description of the presently preferred exemplary embodiments of the invention taken in conjunction with the accompanying drawings, in which.

DETAILED DESCRIPTION OF THE INVENTION

Figure 1:
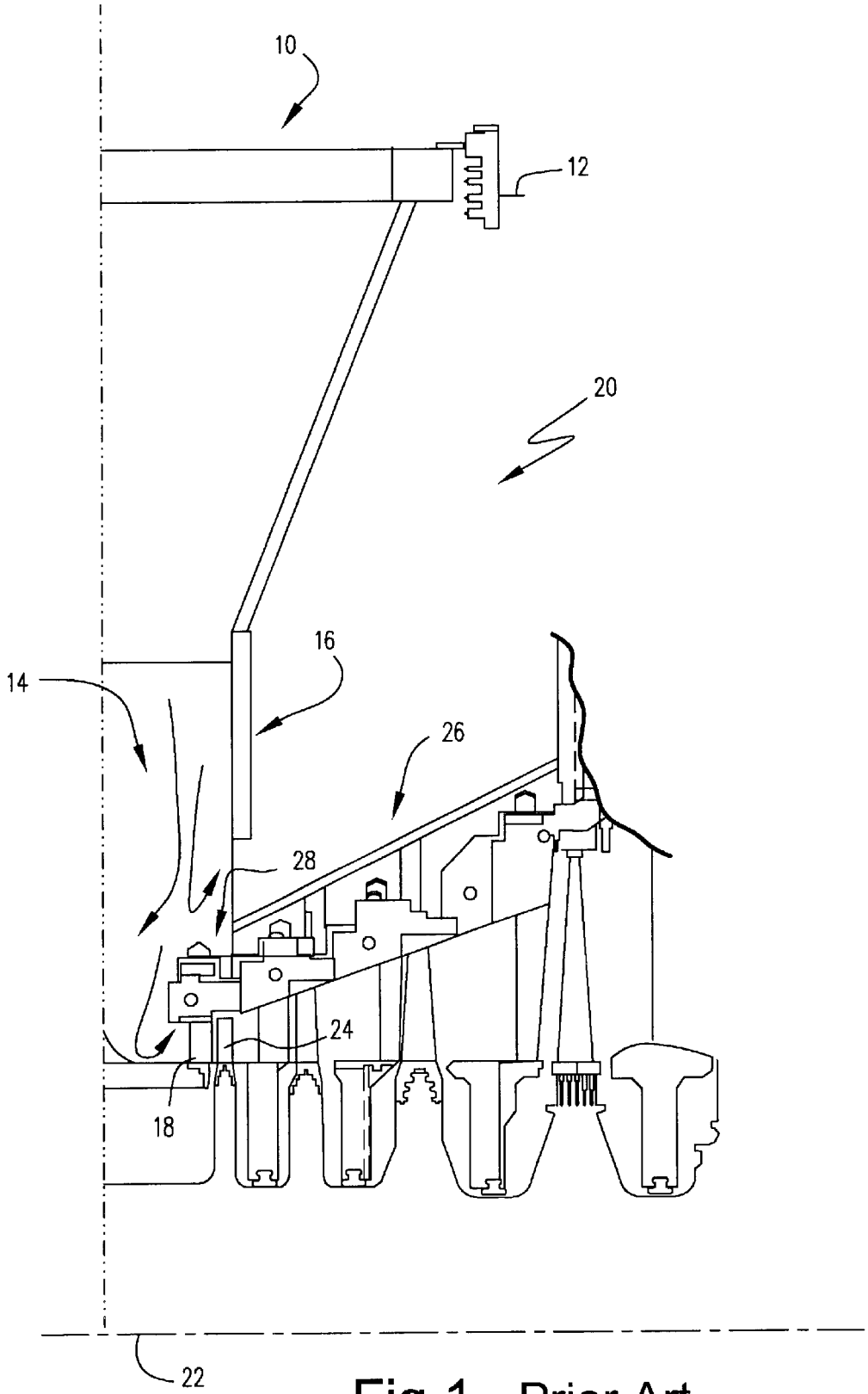
Fig.1 Prior Art
FIG. 1 is a schematic, partial cross-sectional view of a conventional LP turbine and inlet.

In the illustrated turbine, the flow of working fluid (motive steam) is provided through an opening 10 in an outer casing 12 to an inlet chamber 14 in an inlet casing 16 whereupon the steam is directed onto the first annular row of nozzles 18. Thus, the steam entering the turbine 20 is directed transverse to the rotor axis 22, i.e., radially inward. As the steam reaches the area of the nozzles 18, it must be turned through 90° and then redirected by means of the first stationary circumferential blades or nozzles 18 onto a first stage of rotating blades 24.

FIG. 1 schematically illustrates an externally fed LP steam turbine in which the length of the assembled turbine stages is longer than the casing 26 that contains them such that the first stage nozzle diaphragm structure 28 protrudes into the inlet casing. Thus, the first stage nozzle diaphragm ring presents a forward facing step to the inlet flow path. Consequently, steam encounters the step and separates from a smooth flowing pattern as illustrated.

Figure 2:
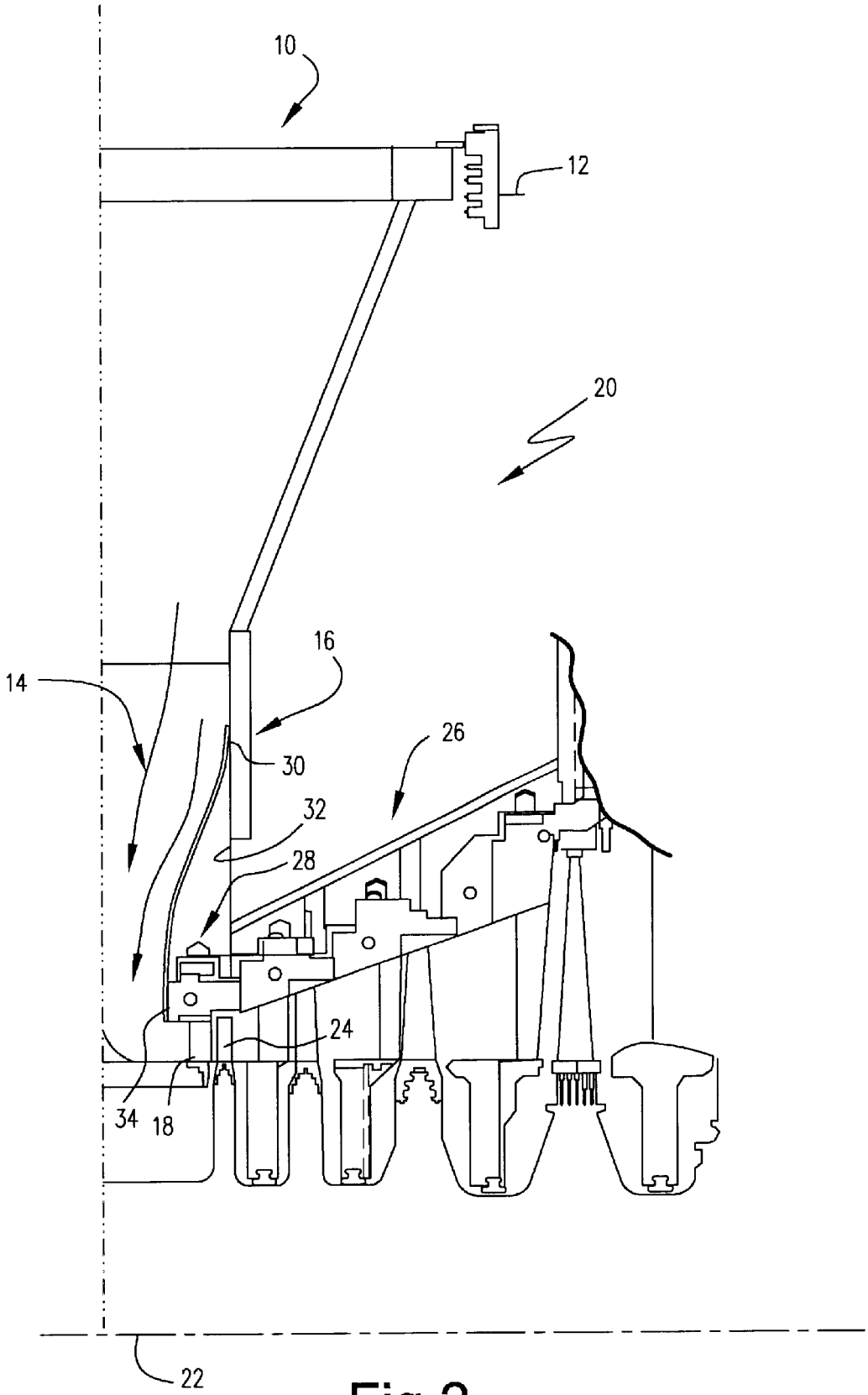
FIG. 2 is a schematic, partial cross-sectional view of the LP turbine and inlet of FIG. 1 with a diaphragm cover embodying the invention mounted thereto.
Figure 3:
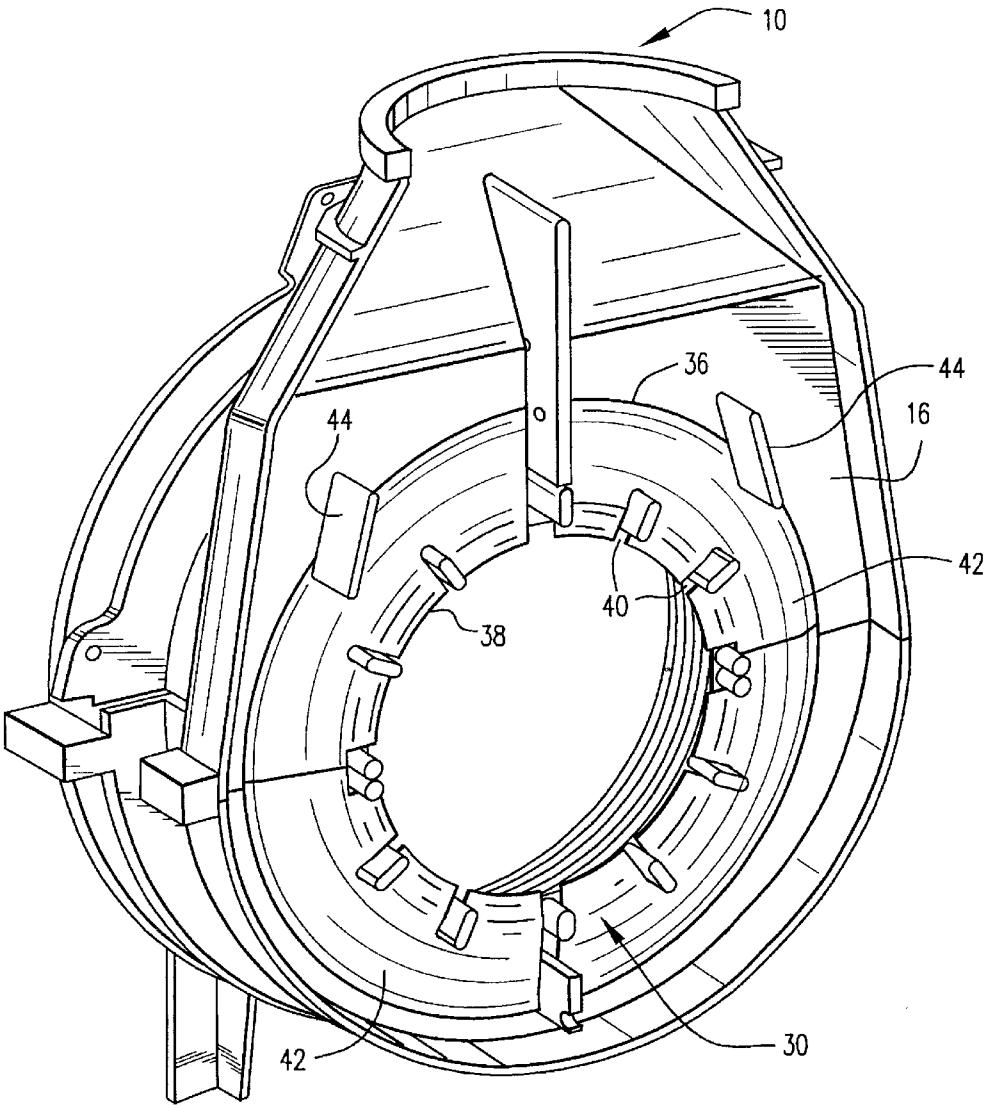
FIG. 3 is a partial, schematic cut-away perspective view of the LP inlet casing showing a diaphragm cover embodying the invention.
Figure 4:
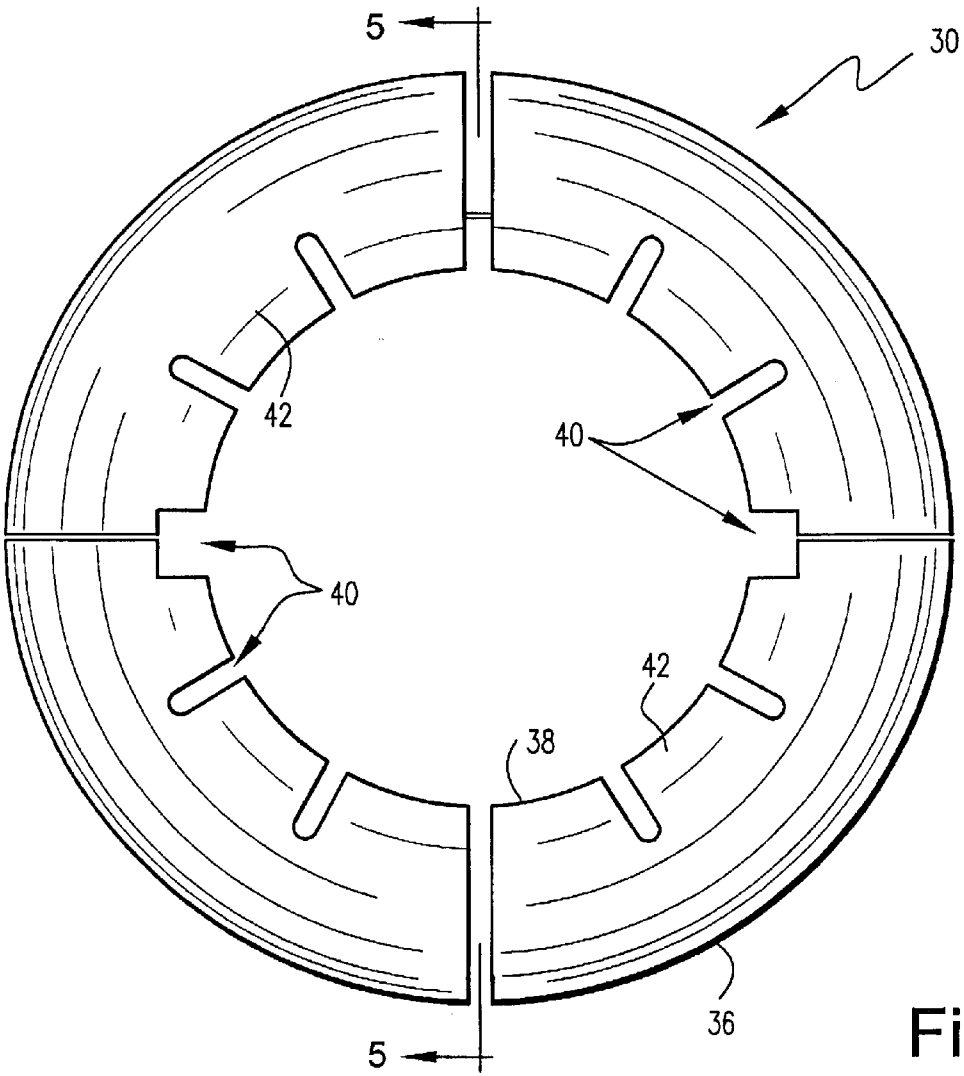
FIG. 4 is an elevational view of a diaphragm cover embodying the invention.
Figure 5:
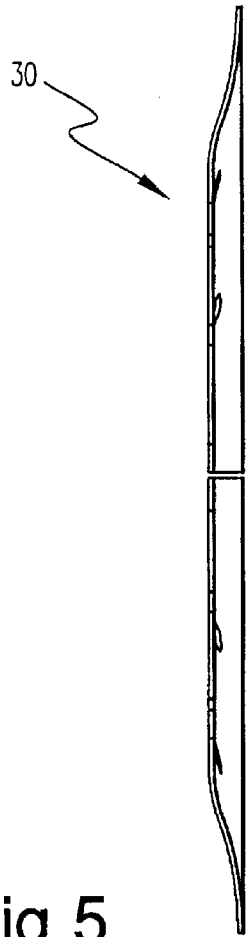
FIG. 5 is a view taken along line 5—5 of FIG. 4.

To conceal the forward facing step 28 generated by the protrusion of the first stage diaphragm 18,24 into the LP inlet, a diaphragm cover 30 is provided to extend from the wall 32 of the inlet casing 16 to the upstream end 34 of the first stage diaphragm. As illustrated in FIGS. 2 and 3, the diaphragm cover has an appropriate contour to define a smoothly contoured surface to the flowing fluid in both radial and circumferential directions. As illustrated in FIGS. 3 and 4, the diaphragm cover has a generally flat plate main body that is of generally circular shape as defined by an outer peripheral edge 36 and an inner peripheral edge 38. The outer peripheral edge is defined as a substantially continuous circle whereas the inner peripheral edge defines a plurality of cutouts 40 so that it is a generally discontinuous circle.

The diaphragm cover may be comprised of a plurality of part circular segments 42 to accommodate protruding parts of the LP inlet and/or first stage diaphragm and/or the casing structure 16. In the presently proposed embodiment, the diaphragm cover 30 is provided as four segments 42, the upper two segments associated with the upper casing half and the lower two segments associated with the lower casing half. Also, the upper two segments and the lower two segments of the diaphragm cover define circumferential gaps at 12:00 and 6:00 to accommodate, e.g., the LP inlet structure, as illustrated in FIG. 3. Cut outs may also be provided if necessary or desirable to accommodate other features of the inlet structure, such as stiffeners 44.

The nozzle diaphragm cover 30 may be constructed of any material that can withstand the environment and attachment criteria for the LP inlet and that can define the appropriate contour. In an exemplary embodiment, the diaphragm cover is fabricated from plate steel formed to fit the appropriate contour and is welded to the inlet. It will be appreciated that the actual configuration and profile of the diaphragm cover will vary depending on the LP inlet dimensions and the diaphragm protrusion.

As will be appreciated, a diaphragm cover 30 embodying the invention may used on any turbine application where a smooth flow of steam is interrupted by the first stage diaphragm protruding into the inlet.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An axial flow turbine including a rotor and turbine blades coupled to said rotor for converting at least a portion of energy available from a working fluid into mechanical energy, comprising:

a diaphragm for circumferential disposition around the rotor for directing at least a portion of said working fluid onto said blades, said diaphragm including a plurality of spaced apart nozzles forming a respective plurality of channels therebetween, an inlet casing for conducting working fluid to an upstream end of said diaphragm, said diaphragm protruding into said inlet casing to define a step, and a cover extending between a wall of said inlet casing and an upstream end of said diaphragm, said cover defining a gradual transition between the inlet casing wall and the upstream end of the diaphragm.

2. An axial flow turbine as in claim 1, wherein said cover comprises a generally flat plate main body having an outer peripheral edge disposed adjacent said wall of said inlet and an inner peripheral edge disposed about and around an inlet opening to said diaphragm.

3. An axial flow turbine as in claim 2, wherein said outer peripheral edge is generally circular and said inner peripheral edge defines a generally discontinuous circle having a plurality of cutouts for receiving protruding structure of said inlet casing.

4. An axial flow turbine as in claim 2, wherein, said cover is pre-formed to define a generally curved contour from a plane of said outer peripheral edge to a plane of said inner peripheral edge, said plane of said outer peripheral edge and said plane of said inner peripheral edge being parallel and spaced apart according to said contour.

5. An axial flow turbine as in claim 2, wherein said main body is comprised of at least two generally semi-circular parts.

6. An axial flow turbine as in claim 5, wherein in each of said semi-circular parts is comprised of first and second segments.

7. An axial flow turbine as in claim 1, wherein said cover is fabricated from plate steel.

8. A turbine comprising:

a shaft which extends along and rotates about a central axis;

a rotor wheel mounted to the rotor;

a plurality of buckets mounted to and around said rotor wheel;

a diaphragm upstream of said rotor wheel, said diaphragm including a plurality of circumferentially arrayed nozzle vanes housed in a stationary flow path component and configured to direct fluid against an upstream side of the buckets to effect rotation of the rotor wheel;

an inlet casing for conducting motive fluid to said diaphragm, said diaphragm projecting axially into an inlet chamber defined by said inlet casing so that said diaphragm defines a step from a wall of said inlet casing to an upstream end of said diaphragm, and a cover extending between said wall of said inlet casing and said upstream end of said diaphragm, said cover defining a gradual transition between the inlet casing wall and the upstream end of the diaphragm.

9. A turbine as in claim 8, wherein said cover comprises a generally flat plate main body having an outer peripheral edge disposed adjacent said wall of said inlet and an inner peripheral edge disposed about and around an inlet opening to said diaphragm.

10. A turbine as in claim 9, wherein said outer peripheral edge is generally circular and said inner peripheral edge defines a generally discontinuous circle having a plurality of cutouts for receiving protruding structure of said inlet casing.

11. A turbine as in claim 9, wherein, said cover is pre-formed to define a generally curved contour from a plane of said outer peripheral edge to a plane of said inner peripheral edge, said plane of said outer peripheral edge and said plane of said inner peripheral edge being parallel and spaced apart according to said contour.

12. A turbine as in claim 9, wherein said main body is comprised of at least two generally semi-circular parts.

13. A turbine as in claim 12, wherein in each of said semi-circular parts is comprised of first and second segments.

14. A turbine as in claim 8, wherein said cover is fabricated from plate steel.

15. A cover for a first stage diaphragm, comprising:

a generally flat plate main body having an outer peripheral edge and an inner peripheral edge, said outer peripheral edge being circular and said inner peripheral edge defining a generally discontinuous circle having a plurality of cutouts for receiving protruding structure of an inlet casing of the first stage diaphragm, said main body being pre-formed to define a generally curved contour from a plane of said outer peripheral edge to a plane of said inner peripheral edge, said plane of said outer peripheral edge and said plane of said inner peripheral edge being parallel and spaced apart according to said contour.

16. A cover as in claim 15, wherein said main body is comprised of at least two generally semi-circular parts.

17. A cover as in claim 16, wherein in each of said semi-circular parts is comprised of first and second segments.

18. A cover as in claim 17, wherein said main body is fabricated from plate steel.

19. A method for improving inflow from an inlet casing of a turbine into a first stage diaphragm thereof when said first stage diaphragm protrudes into said inlet casing, the method comprising:

providing a cover that has a generally flat plate main body having inner and outer peripheral edges and a generally circular shape;

mounting the cover to a wall of the inlet casing adjacent said outer peripheral edge; and disposing the inner peripheral edge of the cover at an upstream end of the first stage diaphragm.

20. A method as in claim 19, wherein said step of providing a cover comprises providing a cover having a generally flat plate main body defining an outer peripheral edge and an inner peripheral edge, said main body being pre-formed to define a generally curved contour from a plane of said outer peripheral edge to a plane of said inner peripheral edge, said plane of said outer peripheral edge and said plane of said inner peripheral edge being parallel and spaced apart according to said contour.

21. A method as in claim 19, wherein said step of mounting comprises welding the cover to a wall of the inlet casing.

* * * * *